US006913206B2

(12) United States Patent
Cobianchi et al.

(10) Patent No.: US 6,913,206 B2
(45) Date of Patent: Jul. 5, 2005

(54) FUEL INJECTOR FOR AN INTERNAL COMBUSTION ENGINE WITH HYDRAULIC PIN ACTUATION

(75) Inventors: Andrea Cobianchi, Bologna (IT); Fabio Cernoia, Zola Predosa (IT)

(73) Assignee: Magneti Marelli Powertrain S.p.A. (IT)

( * ) Notice: Subject to any disclaimer, the term of this patent is extended or adjusted under 35 U.S.C. 154(b) by 131 days.

(21) Appl. No.: 10/630,467

(22) Filed: Jul. 29, 2003

(65) Prior Publication Data

US 2004/0094639 A1 May 20, 2004

(30) Foreign Application Priority Data

Jul. 30, 2002 (IT) ..... BO2002A0497

(51) Int. Cl.[7] ..... F02M 41/16
(52) U.S. Cl. ..... 239/96; 239/533.8; 239/585.1
(58) Field of Search ..... 239/96, 533.3, 239/533.8, 533.9, 585.1

(56) References Cited

U.S. PATENT DOCUMENTS

| | | | | |
|---|---|---|---|---|
| 3,464,627 A | * | 9/1969 | Huber | 239/96 |
| 4,997,133 A | * | 3/1991 | Ausiello et al. | 239/585.2 |
| 5,664,545 A | | 9/1997 | Kato et al. | 123/496 |
| 5,671,715 A | * | 9/1997 | Tsuzuki | 123/467 |
| 6,367,453 B1 | * | 4/2002 | Igashira et al. | 123/467 |
| 6,561,435 B2 | * | 5/2003 | Kluegl | 239/88 |
| 6,568,606 B2 | * | 5/2003 | Boecking | 239/533.2 |
| 6,814,302 B2 | * | 11/2004 | Stoecklein et al. | 239/98 |

FOREIGN PATENT DOCUMENTS

| | | |
|---|---|---|
| DE | 101 64 284 | 7/2002 |
| EP | 0 844 385 | 5/1998 |
| EP | 0 851 115 | 7/1998 |
| EP | 0921302 | 6/1999 |
| EP | 0 999 360 | 5/2000 |
| EP | 1136932 | 9/2000 |
| GB | 2 010 963 | 7/1979 |
| WO | 01/29395 | 4/2001 |

OTHER PUBLICATIONS

European Search Report dated Nov. 11, 2003.

* cited by examiner

*Primary Examiner*—Christopher Kim
(74) *Attorney, Agent, or Firm*—Ostrolenk, Faber, Gerb & Soffen, LLP

(57) ABSTRACT

The injector has a cylindrical body, which houses an injection nozzle regulated by an injection valve provided with a moveable pin, a fuel supply channel, an injection chamber communicating with the fuel supply channel housing a lower portion of the pin and delimited at the bottom by a valve seat for the injection valve, a control chamber communicating with the fuel supply channel and housing an upper portion of the pin, and a control valve, which is of the poppet type and is actuated by an electromagnetic actuator in order to move between a closed position and an open position, in which it puts the control chamber in communication with a low-pressure fuel exhaust passage.

14 Claims, 4 Drawing Sheets

FUEL INJECTOR FOR AN INTERNAL COMBUSTION ENGINE WITH HYDRAULIC PIN ACTUATION

The present invention relates to a fuel injector for an internal combustion engine with hydraulic pin actuation.

The present invention applies advantageously to a direct diesel injection system, which will be referred to explicitly below without thereby losing generality.

BACKGROUND OF THE INVENTION

A known injector is provided with an injection valve having a valve seat, which ends in an injection nozzle and is coupled with a pin capable of moving between a closed position of the valve seat and an open position of the valve seat under the thrust of an actuator; typically the actuator comprises a spring capable of keeping the pin in the closed position and an electromagnet capable of moving the pin from the closed position to the open position against the action of the spring.

Injectors of the type described above are usually called injectors with electromagnetic pin actuation and are very widespread because they combine good performance and low cost. However, the market demands injectors with better dynamic performance and capable of operating at very high pressures of diesel oil; for this reason, injectors have been proposed with hydraulic pin actuation, that is injectors in which the displacement of the pin from the closed position to the open position against the action of the spring happens by the effect of forces of hydraulic origin.

An example of an injector with hydraulic pin actuation is provided by patent application EP-1036932-A2 (or EP-0921302-A2), in which a lower portion of the pin is housed in an injection chamber, which is delimited at the bottom by the valve seat for the injection valve and an upper portion of the pin is housed in a control chamber, which houses the spring that holds the pin in the closed position; diesel oil is fed constantly at pressure either to the injection chamber, which it leaves via the injection nozzle when the pin is in the open position, or to the control chamber. The control chamber is coupled to a control valve, which is actuated by an electromagnetic actuator in order to move between a closed position and an open position, in which it puts the control chamber in communication with a low-pressure exhaust environment.

In use, when the control valve is closed, the pressure of the diesel oil in the control chamber is equal to the pressure of the diesel oil in the injection chamber, and the pin is held in the closed position either by the action of the spring, or by the hydraulic force that is generated because the area of the pin subjected to the action of the diesel oil is higher in the upper portion housed in the control chamber than in the lower portion housed in the injection chamber. When the control valve is opened, the pressure of the diesel oil in the control chamber tends to fall to much lower values than the pressure of the diesel oil in the injection chamber, and the pin is moved upwards in the open position by the effect of the hydraulic force that is generated by the difference in the pressures.

Another example of an injector with hydraulic pin actuation is provided by patent application WO-0129395-A1, in which an upper portion of the pin is housed in the control chamber, while a lower portion of the pin is housed in an injection chamber, which is delimited at the bottom by the valve seat of the injection valve and houses the spring that holds the pin in the closed position; the control chamber is coupled to the control valve, which is actuated by a piezoelectric actuator in order to move between a closed position and an open position in which it puts the control chamber in communication with a low-pressure exhaust environment.

A further example of an injector with hydraulic pin actuation is provided by patent U.S. Pat. No. 5,664,545-A1, which discloses a fuel injection apparatus including a casing having a control pressure chamber for storing fuel supplied from fuel passage, a needle valve to which fuel stored in the control pressure chamber applies pressure in the valve closing direction, a valve device for interrupting communication between the fuel passage and the control pressure chamber to seal fuel in said control pressure chamber, and volume changing device for expanding volume of the control pressure chamber after fuel is sealed in the control pressure chamber by the valve device; pressure in the control pressure chamber is reduced while the fuel is stored therein by the volume changing device, the nozzle needle is lifted, and injection is started.

It has been observed that in injectors with hydraulic pin actuation of the type described above, when closed the valve body of the control valve tends to rebound against the valve seat of the control valve causing a delay in the effective closing of the control valve and, therefore, of the injection nozzle; in this way, a random, variable error is introduced into the measuring out of the diesel oil, which random error has substantially little influence when operating with long injection times and, therefore, high amounts of injected fuel but is important when operating with short injection times and, therefore, low amounts of injected fuel. This disadvantage is particularly problematic in modern internal combustion engines with direct diesel injection, which, before the main injection of the diesel oil, carry out a series of pilot preinjections close together and marked by very short injection times.

SUMMARY OF THE INVENTION

The aim of the present invention is to produce a diesel oil injector for an internal combustion engine with hydraulic pin actuation that does not have the disadvantages described above and, in particular, is easy and economical to actuate.

According to the present invention a diesel oil injector is produced for an internal combustion engine with hydraulic pin actuation as established by claim 1.

BRIEF DESCRIPTION OF THE DRAWINGS

The present invention will now be described with reference to the attached drawings, which illustrate some non-exhaustive embodiments thereof, in which.

DETAILED DESCRIPTION OF THE INVENTION

Figure 1:
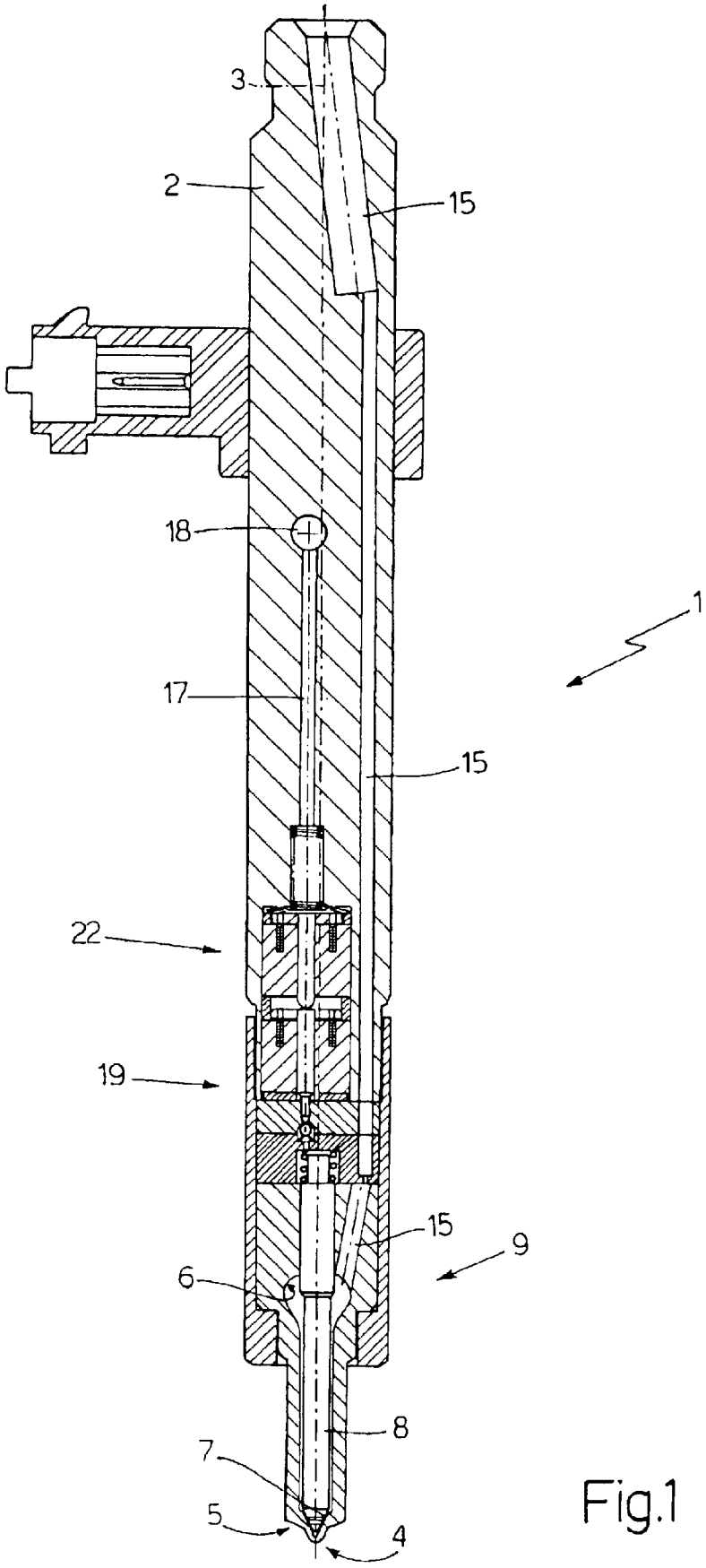
FIG. 1 is a diagrammatic view, in side elevation, partially cut away, of a diesel oil injector produced according to the present invention.

In FIG. 1, the reference number 1 indicates a diesel oil injector as a whole, which is housed in a cylindrical body 2 having a longitudinal axis 3 and is capable of being controlled in order to inject diesel oil from an injection nozzle 4 regulated by an injection valve 5. An injection chamber 6 is made inside the cylindrical body 2, which injection chamber is delimited at the bottom by a valve seat 7 of the injection valve 5 and houses, slidably, a lower portion of a pin 8 of the injection valve 5, in such a way that the pin 8 can move along the longitudinal axis 3 under the thrust of an actuator device 9 between a closed position and an open position of the valve seat 7; the lower portion of the pin 8 housed in the injection chamber 6 has an element 10 in the shape of a truncated cone, which determines a reduction in the section of said pin 8.

An upper portion of the pin 8 is housed in a control chamber 11 and is coupled to a spring 12 that exerts on said pin 8 a downward force that tends to hold said pin 8 in the aforementioned closed position. In particular, the upper portion of the pin 8 has a tapered shape with a further change of section, which determines a surface 13 shaped like a circular crown, from the centre of which there rises a cylindrical body 14 having the function of limiting the upward travel of the pin 8 against an upper surface of the control chamber 11; the spring 12 is arranged coaxially with the cylindrical body 14 so as to be compressed between the surface 13 shaped like a circular crown and the upper surface of the control chamber 11.

It is important to observe that, in the injection chamber 6, the effective area AU1 of the pin 8 on which the pressure of the diesel oil acts in order to determine a thrust along the longitudinal axis 3 is relatively small and is substantially equal to the sum of the area generated by the change in the section of the pin 8 in correspondence with the element 10 in the shape of a truncated cone and the area of the tip of the pin 8 not coupled to the valve seat 7 and immersed in the diesel oil; in contrast, in the control chamber 11 the effective area AU2 of the pin 8 on which the pressure of the diesel oil acts in order to determine a thrust along the longitudinal axis 3 is equal to the entire section of the pin 8 and is therefore greater than the effective area AU1 of the pin 8 in the injection chamber 6.

Furthermore, the cylindrical body 2 has a supply channel 15, which starts from an upper end of the cylindrical body 2 and is capable of supplying the diesel oil at pressure to the injection chamber 6; from the supply channel 15 another supply channel 16 branches off, which is capable of putting the supply channel 15 in communication with the control chamber 11 for supplying the diesel oil at pressure to the control chamber 11 also.

An exhaust channel 11 leaves from the control chamber 11, which exhaust channel is capable of putting the control chamber 11 in communication with an exhaust conduit 18 for the diesel oil ending in an environment for collecting and recirculating the diesel oil at substantially ambient pressure (not illustrated); the exhaust channel 17 is regulated by a control valve 19, which is arranged near the control chamber 11 and is moveable between a closed position, in which the control chamber 11 is isolated from the exhaust channel 17, and an open position, in which the control chamber 11 is connected to the exhaust channel 17.

The control valve 19 comprises a valve seat 20 made along the exhaust channel 17, and a valve body 21, which is moveable through the exhaust channel 17 and in a direction parallel to the longitudinal axis 3 between an engaged position (corresponding to the control valve 19 when closed) and an unengaged position (corresponding to the control valve 19 when open) of the valve seat 20 under the thrust of an electromagnetic actuator device 22. The control valve 19 is a "poppet" type valve, that is, the valve body 21 of the control valve 19 opens against the pressure of the diesel oil; moreover, as is obvious from the attached figures, control valve 19 is fully housed along the exhaust channel 17, which, for this purpose, has an enlarged section 23 in order to accommodate the actuator device 22.

The valve seat 20 of the control valve 19 is defined by a surface in the shape of a truncated cone determining a narrowing of the exhaust channel 17, while the valve body 21 of the control valve 19 is defined by a spherical body, which is capable of being coupled in a fluid-tight manner with the valve seat 20 by the action of the actuator device 22.

The actuator device 22 comprises a spring 24, which acts directly on the valve body 21 in order to keep said valve body 21 in the aforementioned closed position; in particular, the spring 24 is defined by a ring, which has a configuration in the shape of a truncated cone in order to allow axial elastic deformation and has a relatively low elastic force since, in use, the valve body 21 is held in the aforementioned closed position by the pressure of the diesel oil in the control chamber 11.

The actuator device 22 also comprises a stem 25 which, by means of a spring 26, is kept constantly bearing against the valve body 21 on the opposite side from the spring 24 in order to impart, in use, a thrust on the valve body 21 opposing the action of the spring 24 and the pressure of the diesel oil in order to move the valve body 21 from the aforementioned closed position to the aforementioned open position. The stem 25 is subdivided into two truncated cones 25*a* and 25*b*, each of which is integral with a respective anchor 27 made of ferromagnetic material coupled to a respective electromagnet 28 provided with a coil 29 and a magnetic nucleus 30; in use, when a current flows through the coils 29 of the electromagnets 28, the anchors 27 are attracted magnetically towards the respective magnetic nuclei 30 consequently generating a downward thrust on the stem 25, which determines the movement of the valve body 21 from the aforementioned closed position to the aforementioned open position. The actuator device 22 comprises a pair of electromagnets 28*a* and 28*b* in order to be able to generate a sufficient force of thrust to move the stem 25 and to open the control valve 19 against the pressure of the fuel present in the control chamber 11; for this purpose, the two electromagnets 28*a* and 28*b*, which are mechanically arranged in series with each other so as to add together the respective forces of thrust generated on the stem 25.

As illustrated in the attached figures, the actuator device 22 is held in position inside the enlarged section 23 of the exhaust channel 17 by means of a positioning spring 31 (defined by a ring having a configuration in the shape of a truncated cone in order to allow elastic axial deformation) and by a series of positioning annular elements 32.

The section of the supply channel 16, the section of the control valve 19 and the section of the exhaust channel 17 have dimensions with respect to the section of the supply channel 15 such that, when the control valve 19 is open, the pressure of the diesel oil in the control chamber 11 falls to much lower values than the pressure of the diesel oil in the injection chamber 6 and such that the flow rate of diesel oil through the exhaust channel 17 is a substantially negligible fraction of the flow rate of the diesel oil through the injection nozzle 4.

In use, when the electromagnets 28 are de-excited, the force generated by the spring 24 and the pressure of the diesel oil in the control chamber 11 keep the control valve 19 in the closed position; therefore the pressure of the diesel oil in the control chamber 11 is the same as the pressure of the diesel oil in the injection chamber 6 for the purposes of the supply channel 16. In this situation, the force generated by the spring 12 and the hydraulic force generated by the imbalance of the effective areas AU1 and AU2 of the pin 8, in favour of the control chamber 11 with respect to the injection chamber 6, keep the injection valve 5 in the aforementioned closed position.

When the electromagnets 28 are actuated by means of circulation of an electrical current, the control valve 19 is put into the open position as described above, therefore the control chamber 11 is put into communication with the exhaust conduit 16 and the pressure of the diesel oil in the control chamber 11 falls to much lower values than the pressure of the diesel oil in the injection chamber 6; as stated previously, the difference between the pressures of the diesel oil in the injection chamber 6 and in the control chamber 11 is due to the dimensions of the sections of the supply channel 16, the control valve 19 and the exhaust channel 17 with respect to the section of the supply channel 15.

Because of the imbalance between the pressures of the diesel oil in the injection chamber 6 and the control chamber 11, a hydraulic force is generated on the pin 8 that is capable of moving the pin 8 upwards against the action of the spring 12 so as to put the injection valve 5 in the aforementioned open position and to allow the injection of the diesel oil through the injection nozzle 4.

When the electromagnets 28 are de-excited, the force generated by the spring 24 and the pressure of the diesel oil in the control chamber 11 put the control valve 19 back in the closed position; therefore the pressure of the diesel oil in the control chamber 11 tends to rise until it reaches the pressure of the diesel oil in the injection chamber 6. In this situation, the force generated by the spring 12 and the hydraulic force generated by the imbalance of the effective areas AU1 and AU2 of the pin 8 in favour of the control chamber 11 with respect to the injection chamber 6 bring the injection valve 5 back to the aforementioned closed position.

Preferably, the supply channel 15 has a throttled area 33, which is arranged downstream from the branching off of the supply channel 16 and is capable of instantaneously increasing the difference in pressure between the control chamber 11 and the injection chamber 6 during the transitional period of closing of the pin 8 (i.e. when the pin moves from the open position to the closed position of the valve seat 7) in order to increase the force acting on the pin 8 and therefore to accelerate the closing of said pin 8.

When the injector 1 is in the operating condition, that is, it is receiving diesel oil under pressure, the valve body 21 of the control valve 19 is acted upon by the force of the spring 24 and the force of the pressure of the diesel oil in the control chamber 11 which forces tend to keep the valve body 21 in the closed position, and is acted upon by the force of the spring 26 and the force of the electromagnets 28, which forces tend to keep the valve body 21 in the open position. When the injector 1 is in the rest condition, that is, it is not receiving diesel oil under pressure, the valve body 21 of the control valve 19 is acted upon solely by the force of the spring 24, which tends to keep the valve body 21 in the closed position, and the force of the spring 26, which tends to keep the valve body 21 in the open position. According to a possible embodiment, the springs 24 and 26 have dimensions such that, when the injector 1 is in the rest condition, the control valve 19 is open, that is, the force exerted by the spring 26 is greater than the force exerted by the spring 24; in this way, the control valve 19 remains open until the pressure of the diesel oil inside the control chamber 11 reaches the minimum threshold value, and any air present inside the injection system can be cleared through the exhaust channel 17.

Figure 2:
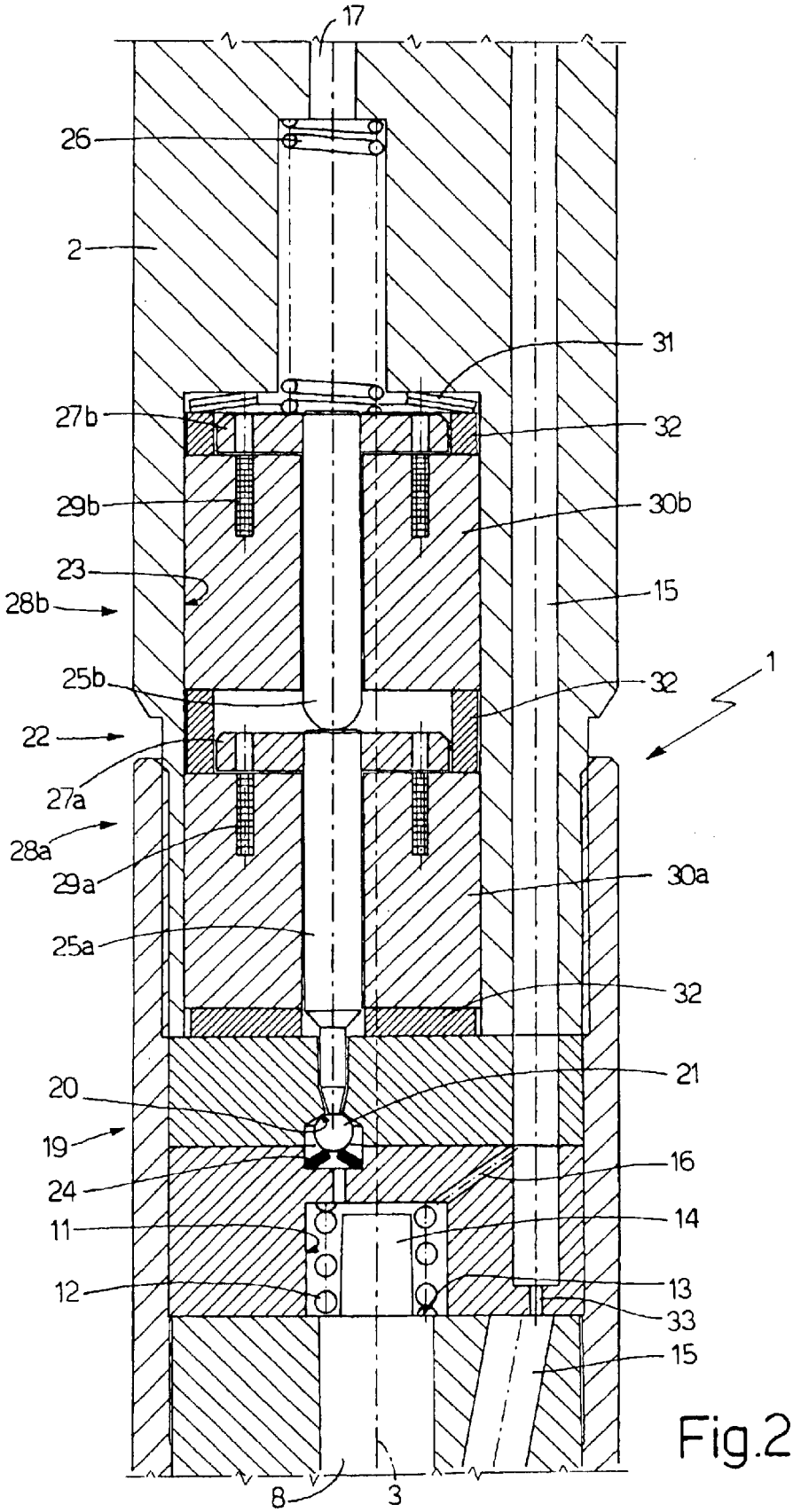
FIG. 2 is a view on a larger scale of a detail of FIG. 1.
Figure 3:
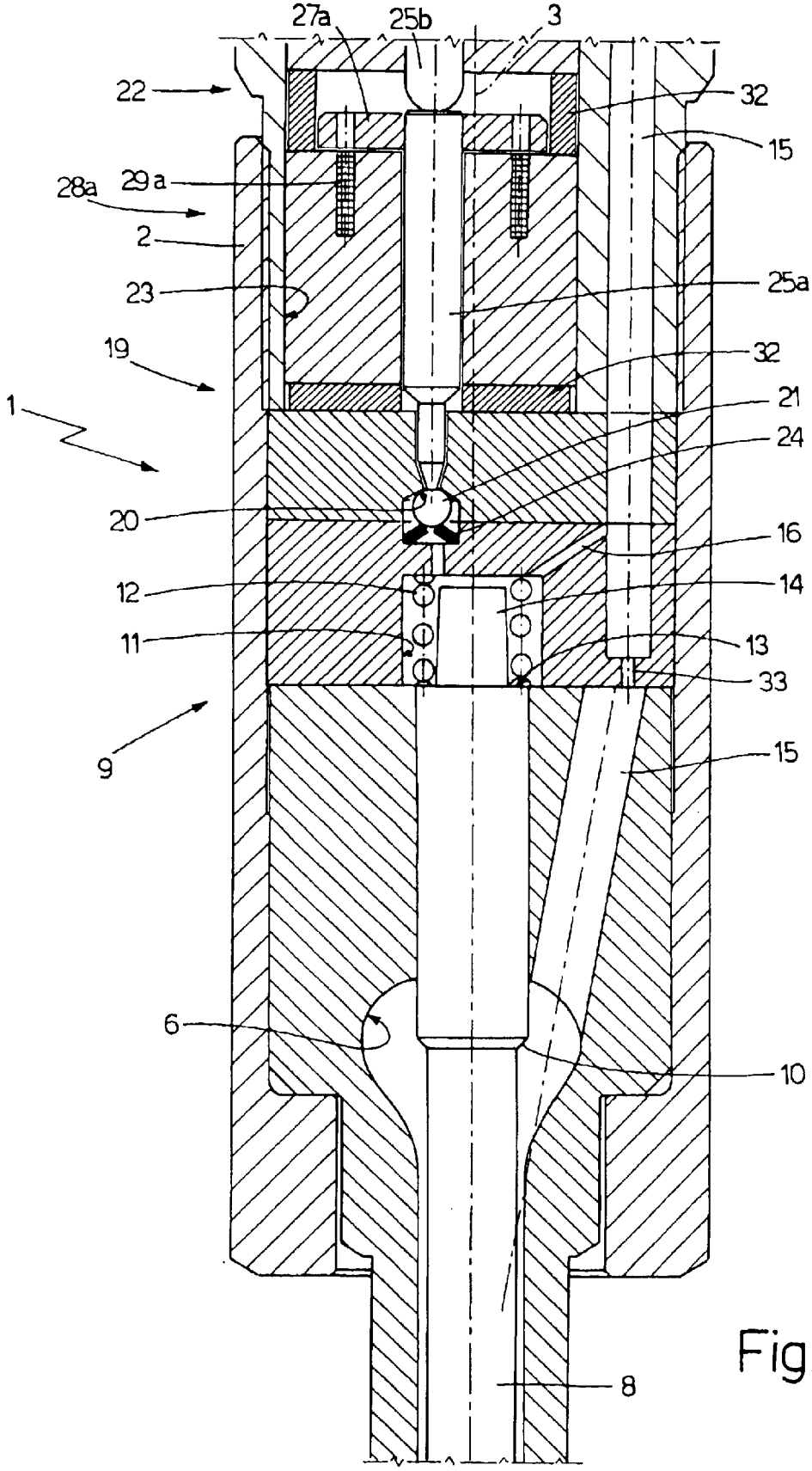
FIG. 3 is a view on a larger scale of another detail of FIG. 1.
Figure 4:
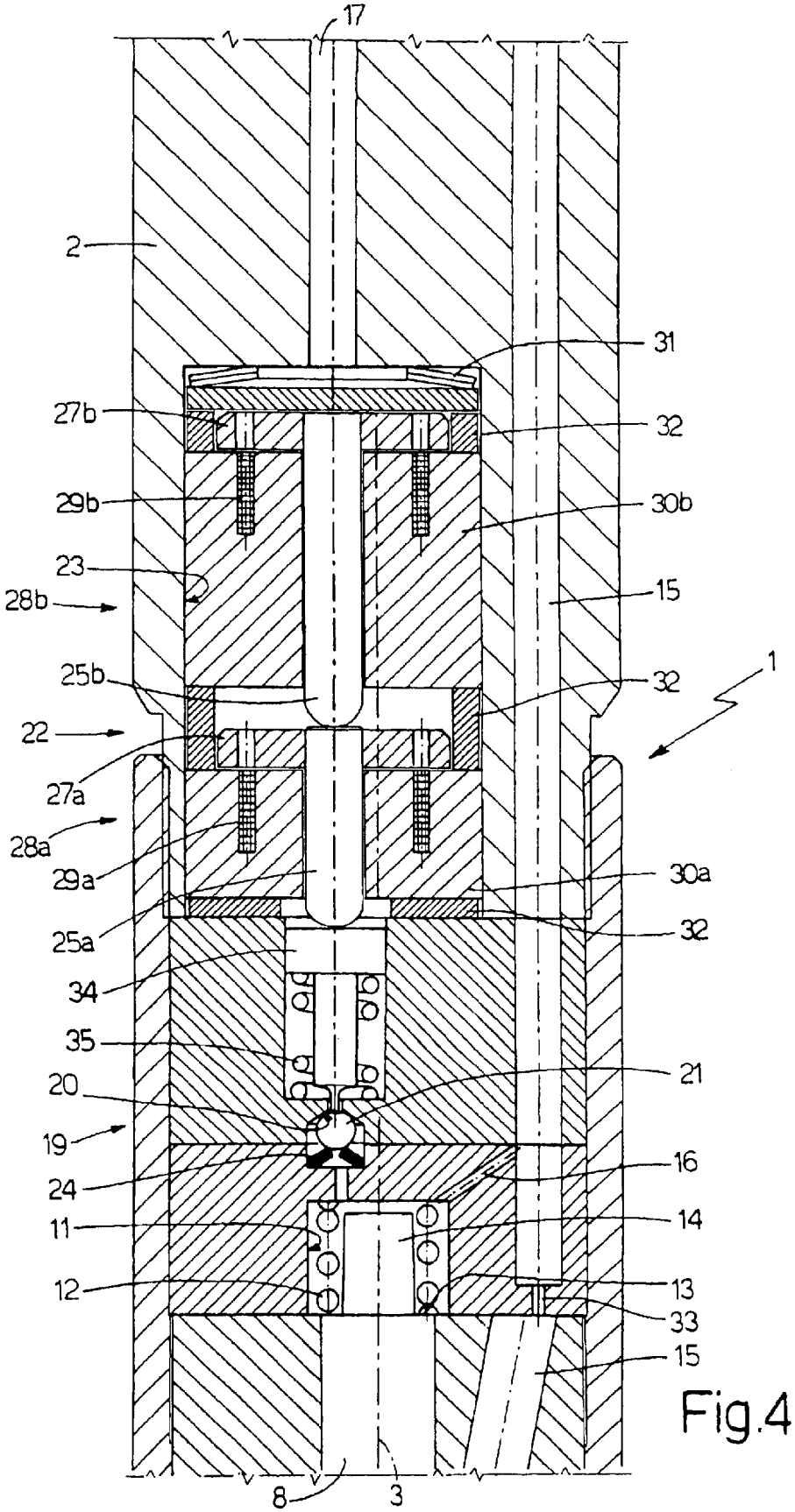
FIG. 4 is a view on a larger scale of a detail of FIG. 1 according to another embodiment.

According to the embodiment illustrated in FIG. 4, the stem 25, subdivided into the two truncated cones 25*a* and 25*b*, bears against another stem 34, which on the one hand is held pressed against the stem 25 by a spring 35 and on the other hand bears against the valve body 21; the spring 35 replaces the spring 26 illustrated in FIGS. 1 and 2, since pushing the stem 34 against the stem 25 prevents the stem 34 from pressing on the valve body 21 when the electromagnets 28 are de-excited. In particular, the stem 34 has dimensions so as to be separated from the valve body 21 by a given distance when the electromagnets 28 are de-excited; in this way, any play and/or structural tolerances only vary in the distance between the tip of the stem 34 and the valve body 21 without any consequence on the functionality of the injector 1.

Experimental tests have demonstrated that the injector 1 described above has optimal dynamic characteristics even when operating at very high diesel oil pressures, and substantially do not present rebound phenomena of the valve body 21 when closed against the valve seat 20; in this way, the measuring out of the diesel oil is always very precise and in particular a series of pilot pre-injections of diesel oil marked by a very short injection time can be executed with precision and in fast sequence. Moreover, the injector 1 described above is economical and compact, since it uses electromagnetic actuators (decidedly more economic than piezoelectric actuators), which are housed entirely within the cylindrical body 2.

What is claimed is:

1. Fuel injector for an internal combustion engine; the injector (1) comprising a cylindrical body (2), which houses an injection nozzle (4) regulated by an injection valve (5) provided with a moveable pin (8), a fuel supply channel (15), an injection chamber (6) communicating with the fuel supply channel (15), housing a lower portion of the pin (8) and delimited at the bottom by a valve seat (7) for the injection valve (5), a control chamber (11) communicating with the fuel supply channel (15) and housing an upper portion of the pin (8), and a control valve (19), which is actuated by an electromagnetic actuator device (22) in order to move between a closed position and an open position, in which it puts the control chamber (11) in communication with an exhaust conduit (18) for the fuel at low pressure; the injector (1) being characterised by the fact that the control valve (19) is a poppet valve that opens against the pressure of the fluid; an exhaust channel (17) parallel to the longitudinal axis (3) of the cylindrical body (2) and housed entirely within the cylindrical body (2) putting the control chamber (11) in communication with an exhaust conduit (18) and being regulated by the control valve (19), which comprises a valve seat (20) produced along the exhaust channel (17), and a valve body (21) moveable through the exhaust channel (17) under the thrust of the electromagnetic actuator device (22), which is housed entirely along the exhaust channel (17).

2. Injector according to claim 1, in which the lower portion of the pin (8) housed in the injection chamber (6) has an element (10) in the shape of a truncated cone that determines a reduction in the section of said pin (8).

3. Injector according to claim 1, in which the upper portion of the pin (8) housed in the control chamber (11) is coupled to a first spring (12), which exerts on said pin (8) a force that tends to hold said pin (8) in a closed position of the injection nozzle (4).

4. Injector according to claim 3, in which the upper portion of the pin (8) has a tapered shape with a change in section that determines a surface (13) in the shape of a circular crown, from the centre of which rises a cylindrical body (14) having the function limiting the travel of the pin (8) against an upper surface of the control chamber (11); the first spring (12) being arranged around the cylindrical body (14) so as to be compressed between the surface (13) in the shape of a circular crown and the upper surface of the control chamber (11).

5. Injector according to claim 1, in which the injection chamber (6) is fed directly from the supply channel (15); another supply channel (16) being provided, which branches off from the supply channel (15), is capable of putting the supply channel (15) in communication with the control chamber (11).

6. Injector according to claim 5, in which the supply channel (15) has a throttled area (33), which is arranged downstream from the branching off of the other supply channel (16).

7. Injector according to claim 1, in which the valve seat (20) of the control valve (19) is defined by a surface in the shape of a truncated cone determining a narrowing of the exhaust channel (17); the valve body (21) of the control valve (19) being defined by a spherical body, which is capable of being coupled in a fluid-tight manner with the valve seat (20) by the action of the actuator device (22).

8. Injector according to claim 7, in which the actuator device (22) comprises a second spring (24), which acts directly on the valve body (21) in order to keep said valve body (21) in a closed position of the exhaust channel (17).

9. Injector according to claim 8, in which the second spring (24) is defined by a ring, which has a configuration in the shape of a truncated cone in order to allow elastic axial deformation.

10. Injector according to claim 8, in which the actuator device (22) comprises a stem (25), which by means of a third spring (26) is held constantly bearing against the valve body (21) from the opposite side with respect to the second spring (24).

11. Injector according to claim 10, in which the force exerted on the valve body (21) of the third spring (26) is greater than the force exerted on the valve body (21) by the second spring (24) in such a way that the control valve (19) is opened when the injector (1) is in the rest condition.

12. Injector according to claim 8, in which the actuator device (22) comprises a stem (25) that bears against another stem (34), which on the one hand is held pressed against the stem (25) by a fourth spring (35) and on the other hand bears against the valve body (21).

13. Injector according to claim 12, in which the other stem (34) has dimensions so as to be separated from the valve body (21) by a given distance when the actuator device (22) is de-excited.

14. Injector according to claim 1, in which the actuator device (22) comprises a stem (25) that is capable of moving the valve body (21) and is subdivided into two truncated cones (25*a*, 25*b*) aligned with each other and each of which is integral with a respective anchor (27) of ferromagnetic material coupled to a respective electromagnet (28) provided with a coil (29) and a magnetic nucleus (30).

* * * * *